United States Patent [19]

Murakami et al.

[11] Patent Number: 4,523,321

[45] Date of Patent: Jun. 11, 1985

[54] VERTICAL CARBONIZING FURNACE FOR USE IN THE PRODUCTION OF CARBON FIBERS

[75] Inventors: Yukihiro Murakami, Ehime; Shigeomi Murakami, Otsu; Katsunosuke Maeda, Nishinomiya, all of Japan

[73] Assignee: Toray Industries, Inc., Tokyo, Japan

[21] Appl. No.: 498,526

[22] Filed: May 26, 1983

[30] Foreign Application Priority Data

May 26, 1982 [JP] Japan ..... 57-88119

[51] Int. Cl.[3] ..... F27B 9/04

[52] U.S. Cl. ..... 373/110; 373/128; 373/2; 373/135

[58] Field of Search ..... 373/110, 128, 132, 135

[56] References Cited

U.S. PATENT DOCUMENTS 4,020,273 4/1977 Dix et al. ..... 373/110

FOREIGN PATENT DOCUMENTS 2059406 4/1981 United Kingdom .

*Primary Examiner*—A. D. Pellinen
*Assistant Examiner*—Gregory D. Thompson
*Attorney, Agent, or Firm*—Birch, Stewart, Kolasch & Birch

[57] ABSTRACT

A vertical carbonizing furnace for use in the production of carbon fibers is provided with a vertically extending conduit of hollow rectangular parallelepiped. The lower end of the conduit is immersed in water thereby making a water seal from environmental air. The conduit is also provided with a gas withdrawal outlet which communicates with the upper portion of the conduit through a gas feeding duct for reuse. The mixture of a vapor evaporated from the water seal and an inert gas is withdrawn from the gas withdrawal outlet and fed to the upper portion of the conduit as gas for sealing thereby preventing fibers and the conduit made of carbon or graphite from being deteriorated by said vapor evaporated from the water seal and providing a gas for sealing the upper end of the conduit.

15 Claims, 6 Drawing Figures

VERTICAL CARBONIZING FURNACE FOR USE IN THE PRODUCTION OF CARBON FIBERS

BACKGROUND OF THE INVENTION

1. Field of the Invention

This invention relates to a vertical carbonizing furnace for use in the production of carbon fibers.

2. Description of the Prior Art

In the past, it has been known to pre-carbonize, by oxidation, fibers composed of organic polymers such as polyacrylonitrile, cellulose, pitch, etc. and subsequently carbonize thus pre-carbonized fibers in an inert gaseous atmosphere in a carbonizing furnace to thereby, through continuous operation of the processes, obtain carbon fibers remarkably useful as reinforcing constituent, heat- or cold-resisting material, etc.

Carbon fibers are produced through the carbonizing process such that the pre-carbonized fibers are carbonized by heat in an inert gaseous atmosphere at temperatures in the range of 700° to 1,800° C., or more.

A conventional vertical carbonizing furnace is, as shown in U.S. Pat. No. 4,020,273, a vertically extending hollow cylindrical furnace and the pre-carbonized fiber subjected to oxidation (hereinafter referred to as "precursor") is passed through the inside of the furnace while a suitable tension is applied to the precursor. Normally, the carbonizing furnace is vertically provided with a temperature gradient by means of a plurality of heaters and it improves the physical properties of the carbon fibers. A conventional carbonizing apparatus is constituted of a plurality of these vertically extending hollow cylindrical furnaces and one precursor is passed through the central hollow portion of each furnace. According to such a conventional carbonizing apparatus, however, in case of the simultaneous processing of a plurality of precursors, it is necessary to have the same number of cylindrical hollow furnaces as that of the precursors, thus making the apparatus very large. In addition, there is a deficiency that heaters are required to be provided on each furnace thereby causing consumption of a large amount of energy. Therefore, the above-mentioned carbonizing apparatus is not suitable for use in the mass-production of carbon fibers.

Further, with respect to the vertically extending hollow cylindrical furnace, since a vertical conduit in the central portion of the furnace must be filled with an inert gas, the upper and lower ends of the conduit must be sealed. Regarding an effective sealing method to seal the furnace without hindering the precursor from continuously entering and leaving the furnace, as shown in UK Patent Publication No. GB 2059406A, a liquid sealing method requiring immersing one end of a tubular element connecting with the conduit into the liquid and a gas sealing method requiring the blowing of gas for sealing, into the end of the conduit, have been known. With regard to the above mentioned sealing methods, however, it is problematical that in the case of liquid sealing method, if the evaporated liquid enters the furnace, it will deteriorate the fiber in the the furnace or the furnace core. In case when the inert gas is discharged together with the evaporated liquid into the environmental air, it sustains a loss of the inert gas. Moreover, there is also a problem that a great amount of inert gas for sealing is required for the gas sealing method.

SUMMARY OF THE INVENTION

An object of the present invention is to overcome the problems mentioned above and to provide a vertical carbonizing furnace in which a plurality of precursors may be passed through one conduit of the furnace thereby making the vertical carbonizing furnace compact in size and economical in energy consumption and thus to provide a carbonizing furnace suitable for mass-production of carbon fibers.

Another object of the present invention is to provide a vertical carbonizing furnace furnished with effective sealing means useful for preventing unwanted gases or vapors from entering the furnace by virtue of water sealing and also for economizing the consumption of inert gas for sealing by virtue of gas sealing.

A vertical carbonizing furnace according to a preferred embodiment of the present invention is constructed such that a vertical conduit in the carbonizing furnace constitutes a hollow rectangnlar parallelepiped and it is formed of furnace core plates of graphite or carbon. Further, a water seal is provided at the lower end of the conduit and a gas withdrawal outlet is provided in the conduit just above the water seal, the gas withdrawal outlet communicating with the upper portion of the conduit by means of a gas feeding duct for reuse.

BRIEF DESCRIPTION OF THE DRAWINGS

The above and other objects, features and advantages of the invention will become apparent and more readily appreciated from the following detailed description of preferred exemplary embodiments of the invention, taken in conjunction with the accompanying drawings, of which.

DETAILED DESCRIPTION OF A PREFERRED EMBODIMENT

Referring to FIGURES, the present invention will be described hereunder.

Figure 1:
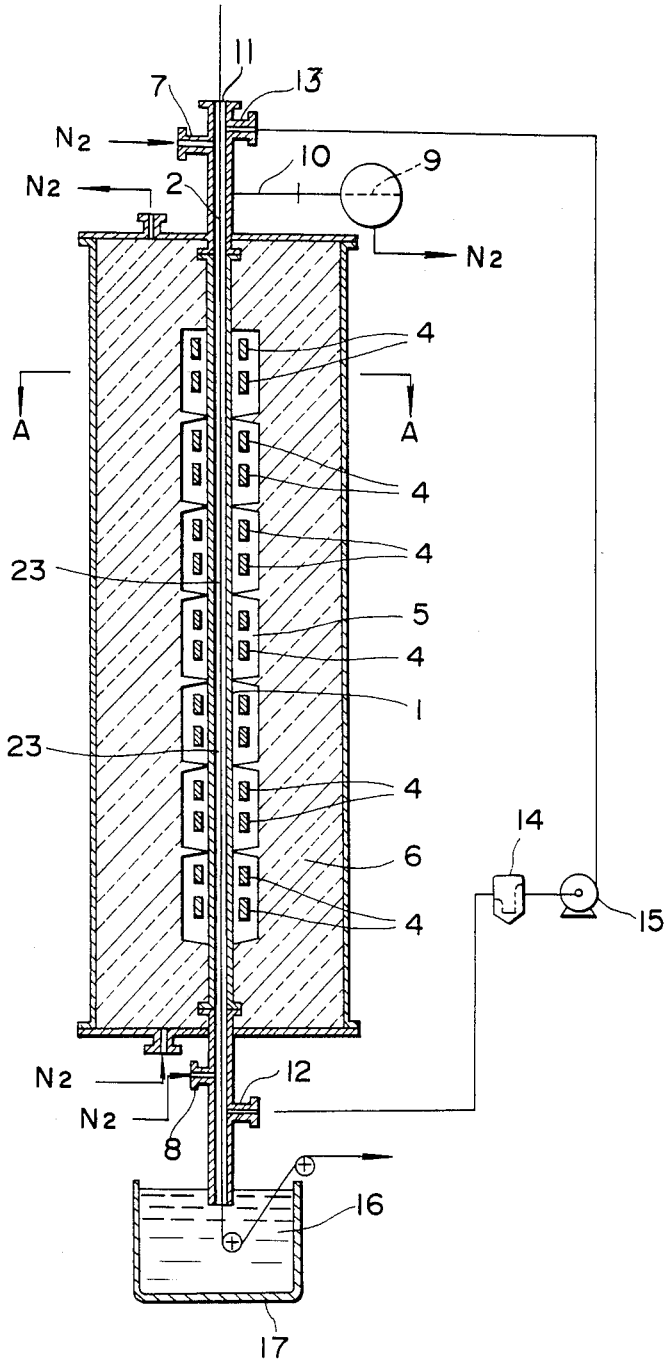
FIG. 1 is a vertical sectional view of a carbonizing furnace according to the present invention.
Figure 6:
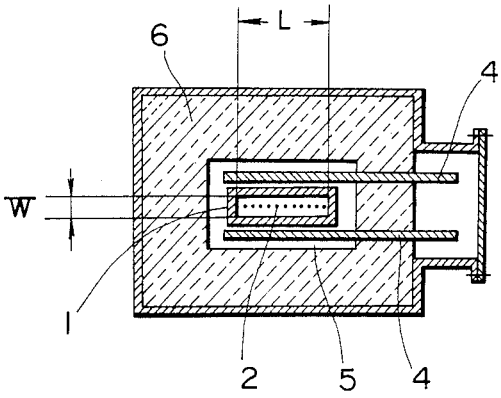
FIG. 6 is a sectional view taken along the line A—A of FIG. 1 of a conduit of the carbonizing furnace of the present invention which has no partition dividing the conduit.

FIG. 1 is a vertical sectional view of a carbonizing furnace according to the present invention and FIG. 6 is a sectional view taken along the line A—A of FIG. 1. In the FIGURES, 1 denotes a conduit formed of furnace core plates of baked and hardened graphite or carbon powders which is resistant to a temperature as high as about 2,500° C. As shown in FIG. 6, the conduit 1 is wholly constituted of one vertically extending hollow rectangular parallelepiped without being divided. A plurality of precursors 2 pass through the conduit 1 in parallel with each other. With respect to the rectangular transverse section of the conduit 1, the ratio of the length L and the width W thereof is preferably 5–9:1, more preferably 6–7:1.

Figure 2:
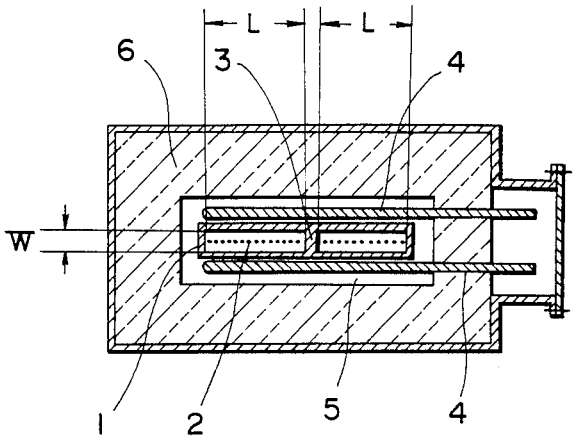
FIG. 2 is a sectional view taken along the line A—A of FIG. 1.

In FIG. 2, the conduit 1 is divided into two divisions by a partition 3 of graphite or carbon. The partition 3 extends vertically and the divisions constitute vertically extending hollow rectangular parallelepipes. However, the conduit 1 may not be divided or if need be, it may be divided into several divisions. In case that the conduit 1 is divided by partition 3, the ratio of the length L and the width W of the rectangular transverse section of each division of the conduit 1 is likewise preferably 5–9:1, more preferably 6–7:1. 4 denotes heaters and they are disposed in hollow chambers 5 located at the outside of the conduit 1, for indirectly heating precursors 2. The heater 4 is constituted at a constant thickness of graphite or carbon and a plurality of heaters 4 are arranged in the longitudinal direction of the conduit 1. Therefore, a desired temperature gradient is provided in the longitudinal direction of the conduit 1 by virtue of varying the voltage for each heater. 6 denotes a heat insulator.

According to the present invention, precursors 2 pass downwardly through the conduit 1 from the upper portion thereof. At the upper portion and the lower portion of the conduit 1, there are provided inert gas introduction inlets 7, and 8 thereby rendering the inside of the conduit 1 an inert gaseous atmosphere by introducing an inert gas such as $N_2$ gas into the conduit 1. Further, an exhaust gas discharge pipe 10 having a filter 9 is provided in the upper portion of the conduit 1 below the inert gas introduction inlet 7. At the uppermost portion of the conduit 1 provided with a fiber introduction inlet, there exists a portion 11 for an environmental seal, which will be explained later.

Below the inert gas introduction inlet 8 at the lower portion of the conduit, there is provided a gas withdrawal outlet 12 which is communicated with the portion 11 for environmental seal at the uppermost portion of the conduit 1 by means of a gas feeding duct 13 for reuse. The gas withdrawn from the gas withdrawal outlet 12 is supplied to the conduit 1 through the gas feeding duct 13 for reuse by means of a blower 15, being separated by a drain separator 14 also serving as a filter. Both the blower 15 and the drain separator 14 are provided intermediately in the gas feeding duct 13.

The lowest portion of the conduit 1 provided with a fiber withdrawal outlet is immersed in the water 16 of a water seal tank 17 located beneath the lowest end of the conduit 1 so as to form a water seal so that the conduit 1 may be completely shut from the environmental air by water.

In case the water in the water seal tank 17 evaporates and enters into the inside of the conduit 1, the evaporated water reacts with the carbon or the graphite forming the conduit 1 and produces toxic and corrosive gaseous by-products to thereby cause the fiber and the conduit 1 to deteriorate. According to the present invention, the mixture of evaporated water and inert gas is drawn out by the blower 15 from the gas withdrawal outlet 12 into the gas feeding duct 13 for reuse and the evaporated water is separated from the mixture by the drain separator 14, also serving as a filter.

The water seal is to completely exclude environmental air and it is capable of preventing the conduit 1 from deteriorating due to oxidation by the environmental air. Furthermore, the inert gas fed to the upper portion of the conduit 1 economically utilized the return gas for sealing.

Next, the portion 11 for environmentally sealing the upper portion of the conduit 1 will be explained below.

Figure 3:
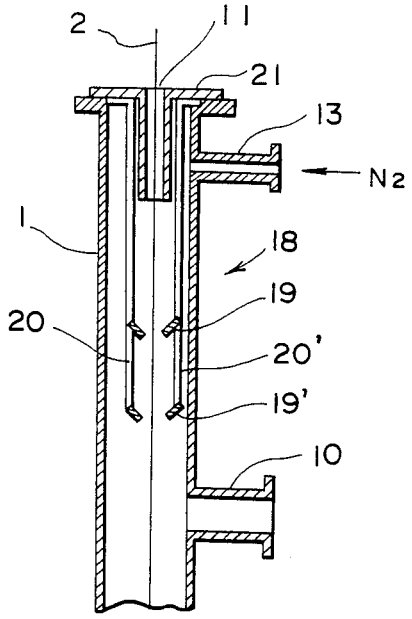
FIG. 3 is an enlarged sectional view of an environmental seal at the uppermost portion of the conduit.

FIG. 3 is an enlarged side sectional view of the portion 11 for the environmental seal at the uppermost portion of the conduit 1. In FIG. 3, 18 represents a device for preventing cool gas from flowing down in which strips 19 slanting downwardly towards the central portion of the conduit 1 are fitted to frames 20, 20′ and the upper portions of the frames 20, 20′ are supported by the upper end of the conduit 1. There is fitted into the device 18 a sealing plug 21 the opening of which is made small so that the precursor may be passed through the opening of the plug 21 and substantially all of environmental air may be excluded.

Figure 4:
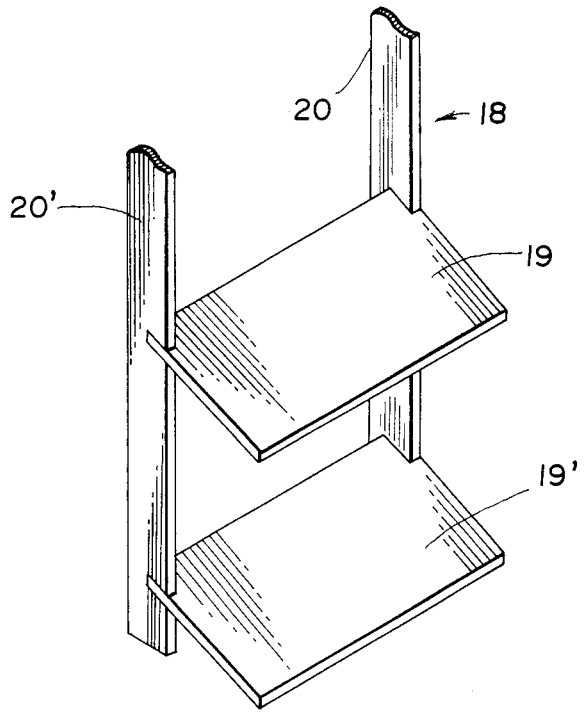
FIG. 4 is a perspective view of a device for preventing cool gas from flowing down.

There may be a pair of devices for preventing cool gas from flowing down inside the upper portion of the conduit 1. FIG. 4 is a perspective view showing one of the two devices and practically, they are used being disposed opposite to each other.

In the present invention, the cool gas at room temperature supplied from the gas feeding duct 13 for reuse is prevented by the slanting strips 19, 19′ from flowing down into the heated portion 23 of the conduit 1 and the cool gas is made to stay in the vicinity of the slanting strips 19, 19′. However, in the case when the devices 18 for preventing the cool gas from flowing down into the conduit 1 are lacking, the cool gas flows down into the heated portion 23 of the conduit 1 thereby making controlling of the heaters difficult and causing the temperature of the conduit 1 to deviate from the prescribed temperature.

Figure 5:
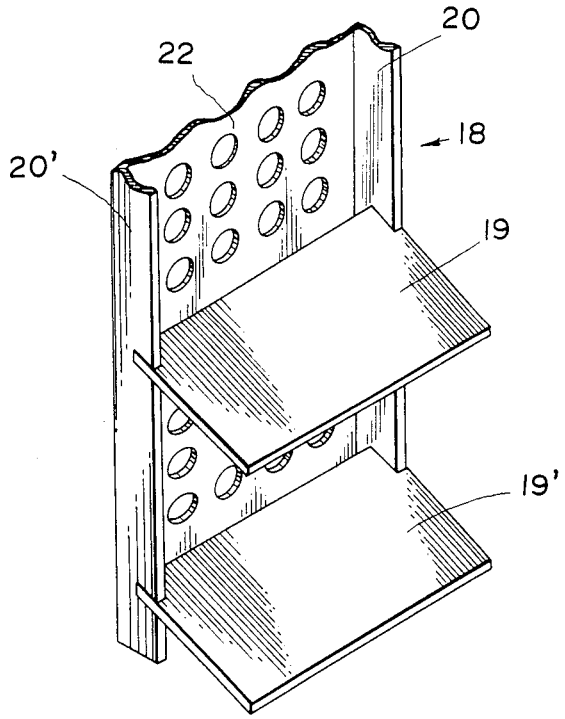
FIG. 5 is a perspective view of another type of a cool gas flowing prevention device.

In the case when the partition 3 is provided, the cool gas prevention device 18 and the sealing plug 21 are provided in each division of the conduit 1 divided by the partition 3. Although the cool gas flows into the upper portion of the conduit 1 from a space between frames 20, and 20′ in FIG. 4, it is possible to adjust the uniform removal of the cool gas by means of a perforated plate 22, as shown in FIG. 5. The perforated plate 22 is supported by the frames 20, and 20′ and disposed opposite to the connecting portion of the gas feeding duct 13 and the upper portion of the conduit 1.

Because of adoption by the present invention of the above-mentioned construction, the following effects are obtained. Since the conduit 1 constitutes a hollow rectangular parallelepiped, it is possible that a plurality of precursors are simultaneously passed through the conduit 1 in parallel with each other thereby making the mass-production of carbon fibers practical and making the apparatus compact and economizing the energy. The temperature gradient in the conduit 1 is freely varied through a plurality of heaters 4 provided in the longitudinal direction of the conduit 1. Further, by virtue of making the temperature of the lowest heater 4 positioned at the bottom of the conduit 1 lower than that of the heater 4 positioned just above it, the amount of thermal energy escaping downward is reduced.

Furthermore, through withdrawing the gas together with the water vapor from the gas withdrawal outlet 12 at the lower portion of the conduit 1, it is possible to prevent the vapor evaporated from the water seal from entering into the conduit 1 and to effect a gas seal at the upper portion of the conduit 1 by feeding the withdrawn gas to the upper portion of the conduit 1 to be used for the gas seal after trapping the vapor from the mixture of gas and vapor, thereby economizing the gas for sealing. The ratios on the basic rate 1 of gas flow at the typical positions of the carbonizing furnace according to the present invention are shown below.

| positions | Ratios on the basic rate 1 |
|---|---|
| inert gas introduction inlet 7 | 0.4–0.6 |
| inert gas introduction inlet 8 | 1 |
| exhaust gas discharge pipe 10 | 0.6–0.9 |
| gas withdrawal outlet 12 | 0.4–0.6 |
| gas feeding duct 13 for reuse | 0.4–0.6 |
| heating portion 23 of the conduit 1 | 0.4–0.6 |
| upper end of the conduit 1 | 0.6–0.9 |

From the ratios of gas flow shown above, it is easily understood that about a half amount of the inert gas introduced into the conduit from the inert gas introduction inlet 8 is fed to the upper portion of the conduit 1 through the gas feeding duct 13 and utilized as the gas for sealing again to thereby save the gas for sealing.

Still further, in case that the partition 3 is provided in the conduit 1, considerable effects are obtained as follows: to serve as reinforcing the conduit 1; to prevent fibers from being involved with problems such as fiber breakage taken place in anyone of them; to prevent deviation from the prescribed temperature; to make threading easy; and to make flowing of the gas uniform.

As a result of the above, by means of the cool gas prevention being provided device 18 being provided, it is possible to adopt room temperature $N_2$ gas as the gas for sealing and by controlling the temperature of each heater 4 it is easy to thereby prevent deviating from the prescribed temperature.

Although only a preferred embodiment of the present invention has been described in detail, it will be appreciated by those skilled in the art that various modifications and alterations can be made of the particular embodiment shown without materially departing from the novel teaching and advantages of this invention. Accordingly, it is to be understood that all such modifications and alterations are included within the scope of the invention as defined by the following claims.

What is claimed is:

1. A vertical carbonizing furnace comprising:

a conduit through which a plurality of precursors pass, said conduit being disposed vertically;

a plurality of heaters vertically disposed at the outside of said conduit;

an inert gas introduction inlet provided in the lower portion of said conduit and an exhaust gas discharge pipe provided at the upper portion of said conduit;

a water seal sealing the lower end of said conduit by virtue of having the lower end of said conduit immersed in water;

a gas withdrawal outlet provided between said water seal and said inlet gas introduction inlet; and a gas feeding duct for reuse through which said gas withdrawal outlet is in communication with the upper portion of said conduit.

2. The vertical carbonizing furnace of claim 1, wherein a third inert gas introduction inlet is further provided in the upper portion of said conduit between said exhaust gas discharge outlet and a second inert gas introduction inlet.

3. The vertical carbonizing furnace of claim 1, wherein said conduit is constituted of single hollow rectangular parallelepiped.

4. The vertical carbonizing furnace of claim 3, wherein said conduit constitutes a hollow rectangular parallelepiped having a ratio of length to width of a rectangular transverse section of being conduit being 5–9:1.

5. The vertical carbonizing furnace of claim 4, wherein said ratio of length to width of said rectangular transverse section of said conduit being 6–7:1.

6. The vertical carbonizing furnace of claim 1, wherein said conduit has vertically extending partitions dividing said conduit into a plurality of divisions.

7. The vertical carbonizing furnace of claim 6, wherein each division of said conduit divided by said partition constitutes a hollow rectangular parallelepiped having a ratio of length to width of a rectangular transverse section of said division being 5–9:1.

8. The vertical carbonizing furnace of claim 7, wherein said ratio of length to width of said rectangular transverse section of each of said divisions being 6–7:1.

9. The vertical carbonizing furnace of claim 1, wherein said conduit is provided with a device preventing cool gas from flowing down into the conduit located at the connecting portion of said gas feeding duct to the upper portion of said conduit.

10. The vertical carbonizing furnace of claim 9, wherein said gas flow prevention device consists of vertically extending frames and slanting strips extending downwardly towards a central portion of said conduit supported by said frames.

11. The vertical carbonizing furnace of claim 9, wherein said gas flow prevention device consists of vertically extending frames and slanting strips extending downwardly towards a central portion of said conduit and a perforated plate being disposed opposite to the connecting portion of said gas feeding duct and the upper portion of said conduit.

12. The vertical carbonizing furnace of claim 1, wherein said conduit is provided with a vertically, downwardly and gradually increasing temperature gradient from the uppermost heater towards the next to the lowest heater.

13. The vertical carbonizing furnace of claim 1, wherein the temperature of the lowest heater is set lower than that of the next preceding heater.

14. A vertical carbonizing furnace comprising:

(a) a conduit through which a plurality of precursors pass continuously, said conduit being disposed vertically;

(b) a plurality of heaters vertically disposed at the outside of said conduit;

(c) a first inert gas introduction inlet provided in the lower portion of said conduit;

(d) an exhaust gas discharge outlet provided in the upper portion of said conduit;

(e) a second inert gas introduction inlet provided in the upper portion of said conduit above said exhaust gas discharge outlet;

(f) a third inert gas introduction inlet provided in the upper portion of said conduit between said exhaust gas discharge outlet and said second inert gas introduction inlet;

(g) a tank containing water being provided below said conduit, with the lower end of said conduit being immersed in said water;

(h) a inert gas withdrawal outlet provided between said water and said first inert gas introduction inlet; and (i) a gas feeding duct one end of which is connected to said gas withdrawal outlet and the other end of which is connected to said second inert gas introduction inlet;

(j) a means drawing said inert gas and water vapor out of said conduit to said gas feeding duct; and (k) a drain separating means provided in said gas feeding duct for removal of water vapor.

15. A vertical carbonizing furnace of claim 14, wherein flowing gas ratios on the basic rate 1 are as follows:

(a) 0.4–0.6 at said third inert gas introduction inlet;
(b) 1 at said first inert gas introduction inlet;
(c) 0.6–0.9 at said exhaust gas discharge outlet;
(d) 0.4–0.6 at said gas withdrawal outlet;
(e) 0.4–0.6 at said second inert gas introduction inlet;
(f) 0.4–0.6 at said conduit between said first inert gas introduction inlet and said exhaust gas discharge outlet; and
(g) 0.6–0.9 at the inlet of said conduit.

* * * * *